US009350090B2

(12) United States Patent
Wu et al.

(10) Patent No.: US 9,350,090 B2
(45) Date of Patent: May 24, 2016

(54) COAXIAL CABLE ASSEMBLY

(71) Applicant: HON HAI PRECISION INDUSTRY CO., LTD., New Taipei (TW)

(72) Inventors: Jerry Wu, Irvine, CA (US); Jun Chen, Kunshan (CN); Zhuang-Zhi Wu, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 102 days.

(21) Appl. No.: 14/250,396

(22) Filed: Apr. 11, 2014

(65) Prior Publication Data

US 2014/0305674 A1 Oct. 16, 2014

(30) Foreign Application Priority Data

Apr. 11, 2013 (CN) ..... 2013 1 01245711

(51) Int. Cl.

| | |
|---|---|
| ***H01B 11/18*** | (2006.01) |
| ***H01B 11/20*** | (2006.01) |
| ***H01R 9/05*** | (2006.01) |
| ***H01R 12/59*** | (2011.01) |

(52) U.S. Cl.

CPC ..... *H01R 9/0524* (2013.01); *H01R 12/598* (2013.01); *H01B 11/203* (2013.01); *Y10T 29/49123* (2015.01)

(58) Field of Classification Search

CPC .. H01R 12/714; H01R 12/598; H01R 9/0524; H01B 11/1808; H01B 11/1813; H01B 11/203; H01B 11/1891

USPC ..... 439/607.56, 497, 607.01

See application file for complete search history.

(56) References Cited

U.S. PATENT DOCUMENTS

| | | | | |
|---|---|---|---|---|
| 6,705,893 | B1 * | 3/2004 | Ko | H01R 12/714 439/497 |
| 2002/0127896 | A1 * | 9/2002 | Lomastro | H01R 9/2483 439/108 |
| 2007/0095555 | A1 * | 5/2007 | Venaleck | H01R 9/0518 174/75 C |
| 2014/0014410 | A1 | 1/2014 | Tanaka | |

FOREIGN PATENT DOCUMENTS

| | | |
|---|---|---|
| CN | 2462568 | 11/2001 |
| CN | 2629241 | 7/2004 |
| CN | 1930737 | 3/2007 |
| CN | 101521321 | 9/2009 |
| CN | 2548310 | 4/2013 |
| JP | 2008192357 | 8/2008 |
| JP | 2009289719 | 12/2009 |

* cited by examiner

*Primary Examiner* — Hoa C Nguyen
*Assistant Examiner* — Amol Patel
(74) *Attorney, Agent, or Firm* — Wei Te Chung; Ming Chieh Chang

(57) ABSTRACT

A coaxial cable assembly including a plurality of first and second wires of different diameters and a grounding member. Each wire defines a central conductor, an inner insulative layer, a shielding layer, and an outer insulative layer. The grounding member surrounds the plurality of wires and electrically connect with the shielding layers of the wires. The grounding member includes a first grounding piece and a second grounding piece having opposing first and second grooves, respectively.

14 Claims, 4 Drawing Sheets

COAXIAL CABLE ASSEMBLY

BACKGROUND OF THE INVENTION

1. Field of the Invention

The present invention relates to a coaxial cable assembly, and more particularly to a grounding member for use in the coaxial cable assembly for accommodating cable wires of different diameters.

2. Description of the Related Art

U.S. Pat. No. 6,544,050, issued on Apr. 8, 2003, discloses a cable connector assembly with an improved grounding device. The cable connector assembly includes a cable connector and a coaxial cable assembly. The coaxial cable assembly includes a plurality of wires arranged in a row and a grounding member surrounding the row of wires. Each wire has a central conductor, an insulative layer, a metallic shielding layer, and an insulative jacket enclosing the metallic shielding layer. A respective front portion of the insulative jacket and the metallic shielding layer is stripped to expose a certain length of the central conductor outside of the metallic shielding layer and the insulative layer. The grounding member is electrically connected to the metallic shielding layer so as to form a grounding path.

Another cable connector assembly is described in U.S. Pat. No. 6,705,893, issued on Mar. 16, 2004. The cable connector assembly comprises a cable consisting of a row of juxtaposed round wires and a conductive grounding bar. The cable wires comprise a plurality of power wires of a larger diameter at a relatively large pitch for power transmission and a plurality of signal wires of a smaller diameter at a relatively small pitch for signal transmission. The grounding bar has upper and lower metal plates and the wires extend through and are clamped between the plates.

SUMMARY OF THE INVENTION

Accordingly, an object of the present invention is to provide a coaxial cable assembly having an improved grounding member to electrically connect with shielding layers of plural cable wires with different diameters through one-shot soldering process.

In order to achieve the object set forth, a coaxial cable assembly comprises: a plurality of wires arranged along a transversal direction and comprising a plurality of first wires and second wires, each of the first wires having a diameter larger than a diameter of each of the second wires, each of the plurality of wires defining a central conductor, an inner insulative layer, a shielding layer, and an outer insulative layer; and a grounding member surrounding the plurality of wires and electrically connected with the shielding layers of the plurality of wires, the grounding member comprising a first grounding piece and a second grounding piece assembled with the first grounding piece, the first grounding piece having two first grooves, the second grounding piece having two second grooves opposing the two first grooves.

DESCRIPTION OF PREFERRED EMBODIMENT

Reference will now be made to the drawings to describe the present invention in detail.

Figure 1:
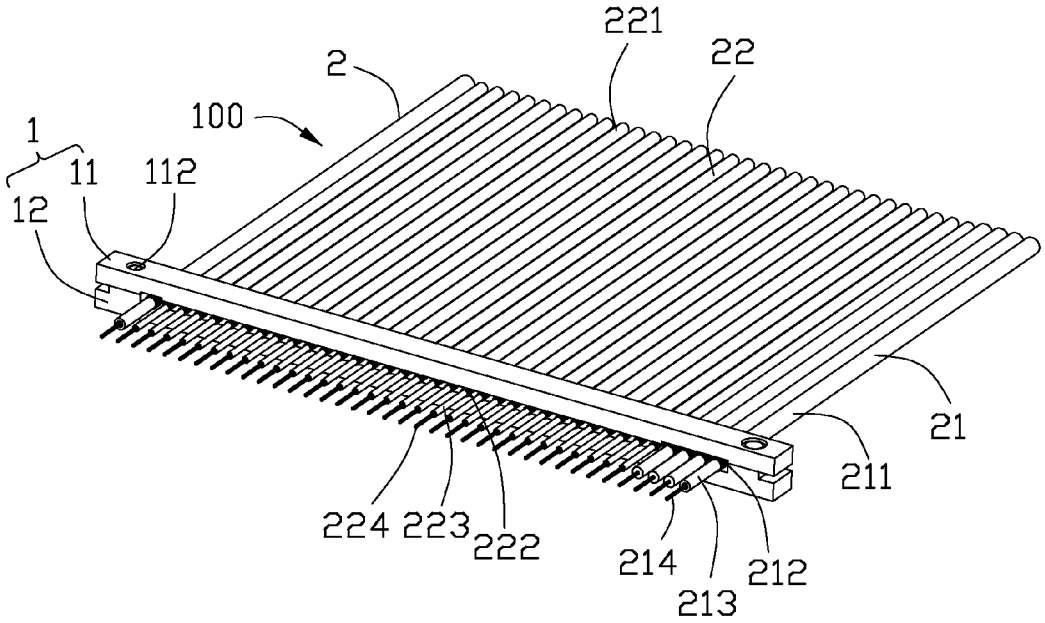
FIG. 1 is an assembled, perspective view of a coaxial cable assembly in accordance with the present invention.

Referring to FIG. 1, a coaxial cable assembly 100 according to the present invention includes a grounding member 1 and a plurality of conductive wires 2. The plurality of wires 2 comprise a plurality of first wires 21 and a plurality of second wires 22 arranged along a transversal direction. Each first wire 21 has a diameter larger than a diameter of the second wire 22. The grounding member 1 comprises a first grounding piece 11 and a second grounding piece 12 assembled with each other along a vertical direction.

Figure 2:
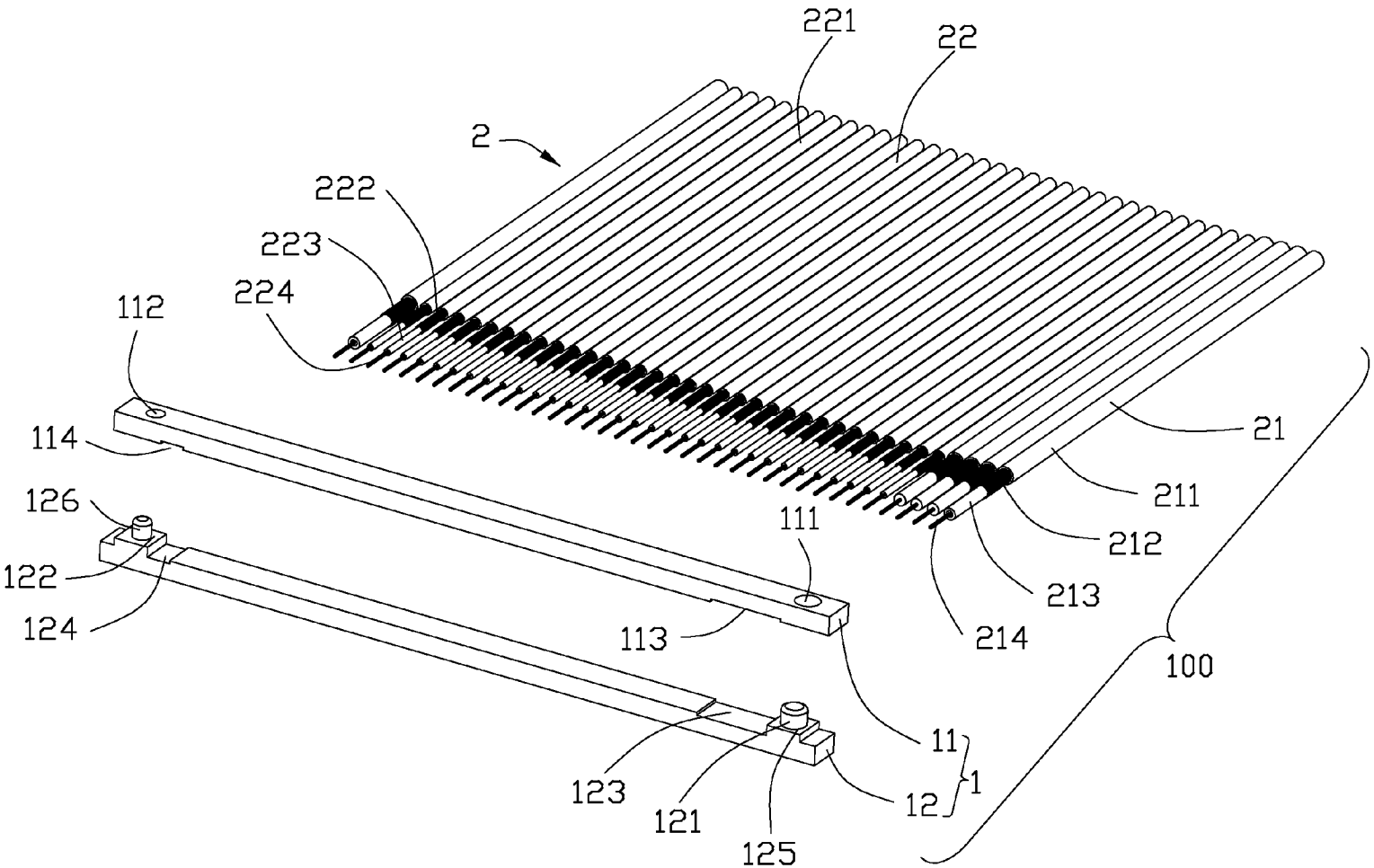
FIG. 2 is an exploded, perspective view of the coaxial cable assembly as shown in FIG. 1.

Referring to FIG. 2, each of first wire 21 comprises a central conductor 214, an insulative layer 213 enclosing the central conductor 214, a metallic shielding layer 212 enclosing the insulative layer 213, and an insulative jacket 211 enclosing the metallic shielding layer 212. The second wire 22 has a same structure as the first wire 21. The second wire 22 comprises a central conductor 224, an insulative layer 223, a metallic shielding layer 222, and an insulative jacket 221, in sequence from inner side to outer side. The plurality of second wires 22 are located between the first wires 21 in the transversal direction. The first wires 21 are located at two sides of the second wires 22. The grounding member 1 includes a first grounding piece 11 and a second grounding piece 12. The first grounding piece 11 defines two spaced first grooves 113, 114 and a first and second positioning holes 111, 112 located at two sides thereof and upon the corresponding standoffs 125, 126, respectively. The second grounding piece 12 defines two spaced first and second positioning posts 121, 122 located at two sides thereof. The second grounding piece 12 further defines two second grooves 123, 124 located on an inner side of the two positioning posts 121, 122. The plurality of first and second wires 21, 22 are sandwiched between the first and second grounding pieces 11, 12. The plurality of first wires 21 are located at two first passages formed by the first and second grounding pieces 11, 12. The first grooves 113, 114 and second grooves 123, 124 are a portion of the first passage. The plurality of second wires 22 are located at a second passage also formed between the first and second grounding pieces 11, 12 and disposed between the two first passages. The first positioning hole 111 has a diameter larger than that of the second positioning hole 112. The first positioning post 121 has a diameter larger than that of the second positioning post 122.

Figure 3:
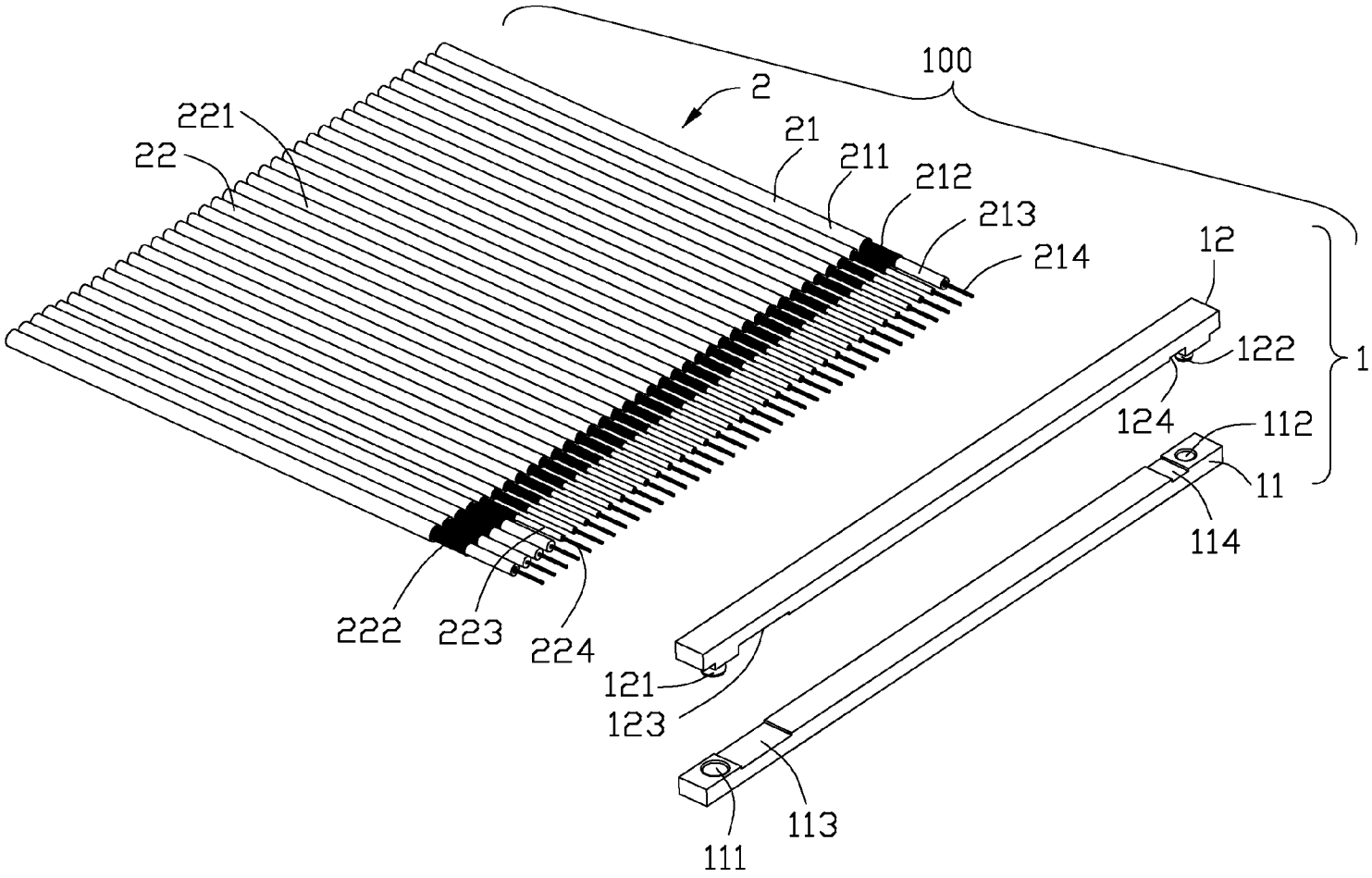
FIG. 3 is an another exploded view of the coaxial cable assembly as shown in FIG. 2.
Figure 4:
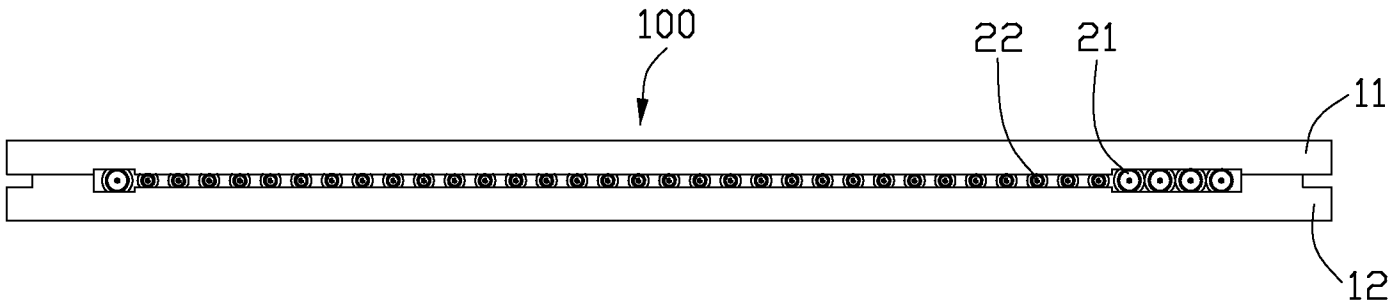
FIG. 4 is a front view of the coaxial cable assembly as shown in FIG. 1.

Referring to FIG. 3, the first and second positioning holes 111, 112 of the first grounding piece 11 are respectively cooperated with the first and second positioning posts 121, 122 of the second grounding piece 12 through riveting process. The metallic shielding layers 212 of the first wires 21 are attached to inner surfaces of the first passages of the grounding member 1. The metallic shielding layers 222 of the second wires 22 are attached to inner surface of the second passages of the grounding member 1. Thus, the metallic shielding layers 212, 222 of the first and second wires 21, 22 are soldered to the grounding member 1 through one-time process. The first and second grounding pieces 11, 12 are engaged with each other through cooperation between the first and second positioning holes 111, 112 and the first and second positioning posts 121, 122.

Referring to FIGS. 1 to 4, the first and second grounding pieces 11, 12 respectively define two first grooves 113, 114 and two second grooves 123, 124. Thus, the grounding member 1 defines two first passages to receive the first wires 21 and a second passage to receive the second wires 22 when the first and second grounding pieces 11, 12 are engaged with each other. The two first grooves 113, 114 and the two second grooves 123, 124 are a portion of the two first passages. Due to the first grooves 113, 114 and the second grooves 123, 124, the first wires 21 can be received into the first passage. As a result, the grounding member 1 can be soldered to the first and second wires 21, 22 through one time only.

What is claimed is:

1. A coaxial cable assembly comprising:

a first group including a plurality of first wires side by side arranged with one another along a transverse direction, each of the first wires extending along a front-to-back direction perpendicular to said transverse direction, each of the first wires including a first inner conductor, a first inner insulator, a first braiding layer and a first outer insulator concentrically arranged with one another in sequence outwardly;

a second group located beside the first group in said transverse direction and including a plurality of second wires side by side arranged with one another, each of said second wires including a second inner conductor, a second inner insulator, a second braiding layer and a second outer insulator concentrically arranged with one another outwardly;

each of the first wires being diametrically smaller than each of the second wires, and the first braiding layer defining a first diameter smaller than a second diameter defined by the second braiding layer; and a common grounding bar forming a receiving space to allow both said first group and said second group to extend therethrough in the front-to-back direction; wherein the receiving space defines in a vertical direction perpendicular to both said transverse direction and said front-to-back direction, a first dimension around the first group to allow the grounding bar to be intimately fused with the exposed first braiding layers of the corresponding first wires in a proper pressure, and a second dimension, around the second group, larger than the first dimension to allow the grounding bar to be intimately fused with the exposed second braiding layers of the corresponding second wires in the proper pressure.

2. The coaxial able assembly as claimed in claim 1, wherein said grounding bar includes a pair of opposite grounding pieces to sandwich both the first group and the second group therebetween.

3. The coaxial cable assembly as claimed in claim 2, wherein each of said grounding pieces forms a groove structure to cooperatively form said receiving space.

4. The coaxial cable assembly as claimed in claim 3, wherein the groove structures of the grounding pieces are asymmetrically arranged with each other relative to an interface between said pair of grounding pieces in the vertical direction.

5. The coaxial cable assembly as claimed in claim 3, wherein one of said grounding pieces forms a standoff beside the corresponding groove structure, and a post extends from said standoff toward the other of said grounding pieces to be received in a corresponding through hole so as to assemble the pair of grounding pieces together.

6. The coaxial cable assembly as claimed in claim 3, wherein the groove structure of the grounding piece is asymmetrically arranged with regard to a center point thereof in said transverse direction, and the grounding piece defines means for assembling to the other grounding piece in only one orientation.

7. The coaxial cable assembly as claimed in claim 6, wherein the second dimension occurs at two opposite positions of the receiving space, and the first dimension occurs at a region between said two opposite positions.

8. A method of assembling a plurality of wires to a grounding bar, comprising steps of:

providing a plurality of first wires side by side arranged with one another along a transverse direction, each of the first wires extending in a front-to-back direction perpendicular to said transverse direction and including a first inner conductor, a first inner insulator, a first braiding layer and a first outer insulator concentrically arranged with one another in sequence outwardly;

providing a plurality of second wires located beside the first wires in said transverse direction and arranged side by side in said transverse direction, each of said second wires extending along the front-to-back direction and including a second inner conductor, a second inner insulator, a second braiding layer and a second outer insulator concentrically arranged with one another outwardly;

providing the grounding bar with a receiving space with both the first wires and the second wires extending therethrough in the front-to-back direction; wherein the receiving space defines in a vertical direction perpendicular to both said transverse direction and said front-to-back direction, a first dimension around the first wires to allow the grounding bar to be intimately fused with the exposed first braiding layers of the corresponding first wires in a proper pressure, and a second dimension, around the second wires, larger than the first dimension to allow the grounding bar to be intimately fused with the exposed second braiding layers of the corresponding second wires in the proper pressure.

9. The method as claimed in claim 8, wherein said grounding bar includes a pair of opposite grounding pieces to sandwich both the first group and the second group therebetween.

10. The method as claimed in claim 9, wherein each of said grounding pieces forms a groove structure to cooperatively form said receiving space.

11. The method as claimed in claim 10, wherein the groove structures of the grounding pieces are asymmetrically arranged with each other relative to an interface between said pair of grounding pieces in the vertical direction.

12. The method as claimed in claim 10, wherein one of said grounding pieces forms a standoff beside the corresponding groove structure, and a post extends from said standoff toward the other of said grounding pieces to be received in a corresponding through hole so as to assemble the pair of grounding pieces together.

13. The method as claimed in claim 10, wherein the groove structure of the grounding piece is asymmetrically arranged with regard to a center point thereof in said transverse direction, and the grounding piece defines means for assembling to the other grounding piece in only one orientation.

14. The method as claimed in claim 13, wherein the second dimension occurs at two opposite positions of the receiving space, and the first dimension occurs at a region between said two opposite positions.

* * * * *